US010322518B2

(12) United States Patent
Kachi et al.

(10) Patent No.: US 10,322,518 B2
(45) Date of Patent: Jun. 18, 2019

(54) CHAINSAW

(71) Applicant: MAKITA CORPORATION, Anjo, Aichi (JP)

(72) Inventors: Hideki Kachi, Aichi (JP); Koji Haneda, Aichi (JP)

(73) Assignee: MAKITA CORPORATION, Anjo, Aichi (JP)

( * ) Notice: Subject to any disclaimer, the term of this patent is extended or adjusted under 35 U.S.C. 154(b) by 96 days.

(21) Appl. No.: 15/450,180

(22) Filed: Mar. 6, 2017

(65) Prior Publication Data

US 2017/0259452 A1 Sep. 14, 2017

(30) Foreign Application Priority Data

Mar. 10, 2016 (JP) ..... 2016-047436

(51) Int. Cl.

| | |
|---|---|
| ***B27B 17/02*** | (2006.01) |
| ***B25F 5/00*** | (2006.01) |
| ***B27B 17/00*** | (2006.01) |
| ***B25F 5/02*** | (2006.01) |

(52) U.S. Cl.

CPC ..... *B27B 17/02* (2013.01); *B25F 5/008* (2013.01); *B25F 5/02* (2013.01); *B27B 17/00* (2013.01); *B27B 17/0033* (2013.01)

(58) Field of Classification Search

CPC .... B26B 21/405; B27B 17/0008; A01G 3/086
See application file for complete search history.

(56) References Cited

U.S. PATENT DOCUMENTS

| | | | | |
|---|---|---|---|---|
| 3,994,067 | A * | 11/1976 | Hazzard | B27B 17/00 123/41.65 |
| 4,680,862 | A * | 7/1987 | Wieland | B27B 17/08 30/381 |
| 4,770,130 | A * | 9/1988 | Nagashima | B27B 17/00 123/195 R |
| 4,785,539 | A * | 11/1988 | Nagashima | B27B 17/0008 30/381 |
| 5,243,764 | A * | 9/1993 | Wieland | B27B 17/02 30/381 |
| 8,757,288 | B2 * | 6/2014 | Heinzelmann | B25F 5/02 173/216 |

(Continued)

FOREIGN PATENT DOCUMENTS

JP 2015-044293 A 3/2015

*Primary Examiner* — Andrea L Wellington
*Assistant Examiner* — Fernando A Ayala
(74) *Attorney, Agent, or Firm* — Sughrue Mion, PLLC

(57) ABSTRACT

Disclosed is a chainsaw capable of introducing outside air into a body casing by rotation of a cooling fan to adequately cool a control unit provided inside the body casing. The chainsaw is configured to cool a control unit provided inside a body casing by a cooling fan being rotated under driving of an electric motor, wherein a handle comprises a base portion through which the handle (30) is attached to the body casing, and a grip formed to extend from the base portion in such a manner as to be grippable by a worker; and an air inlet is formed in a counter wall of the body casing opposed to the base portion of the handle, and wherein the base portion is attached to the counter wall of the body casing to cover the air inlet in an air introduceable state.

2 Claims, 2 Drawing Sheets

(56) References Cited

U.S. PATENT DOCUMENTS

| | | | | |
|---|---|---|---|---|
| 2010/0064532 | A1* | 3/2010 | Wittke | B27G 19/003 30/382 |
| 2010/0218385 | A1* | 9/2010 | Mang | A01G 3/053 30/216 |
| 2012/0011730 | A1* | 1/2012 | Nakamura | F01P 5/06 30/277.4 |
| 2012/0118254 | A1* | 5/2012 | Leufen | F02M 15/022 123/142.5 R |
| 2015/0375315 | A1* | 12/2015 | Ukai | B23D 49/162 30/392 |

* cited by examiner

CHAINSAW

BACKGROUND

1. Field

The present invention relates to a chainsaw for cutting wood such as timber or lumber by a saw chain which is endlessly moved along an outer periphery of a guide bar under driving of an electric motor.

2. Description of the Related Art

JP 2015-044293A discloses a chainsaw for cutting wood such as timber or lumber. This chainsaw comprises a body casing, an electric motor housed in the body casing, a guide bar provided on a front region of a lateral wall of the body casing, and a saw chain wound around an outer periphery of the guide bar. Further, a rear handle is formed integrally with a rear portion of the body casing, and a front handle is fixed to a front portion of the body casing, wherein each of the rear and front handles has a grip to be gripped by a user or worker. In the above chainsaw, when a worker grips the rear handle and the front handle, for example, by his/her right hand and left hand, respectively, and manipulates an operating lever provided in the rear handle, by the right hand, the electric motor is driven, and thus the saw chain is endlessly moved along the outer periphery of the guide bar. Then, the worker can press, against wood such as timber or lumber, the saw chain being endlessly moved along the outer periphery of the guide bar, to cut the wood by the saw chain.

SUMMARY

The chainsaw disclosed in JP 2015-044293A is a type of chainsaw employing an inner rotor-type electric motor with brush as a driving source. On the other hand, another type of chainsaw employing an outer rotor-type brushless electric motor as a driving source to promote reductions in size and weight is being developed. In a chainsaw employing a brushless electric motor, during control of current to be supplied to a stator coil of the electric motor, a control unit for driving the electric motor receives a large load and generates a large amount of heat. Thus, there is a need to adequately cool the control unit. Therefore, with a view to adequately cooling the control unit, the chainsaw is constructed such that a cooling fan is provided on a rotary shaft rotatable along with driving of the electric motor, and an air inlet is formed in a body casing to allow outside air to be introduced into the body casing therethrough during rotation of the cooling fan, to thereby cool the control unit. However, there is a risk that wood chips produced during cutting of wood, dusts or water droplets, enter from the air inlet formed in the body casing, into the body casing, and adhere around the control unit. An aspect of the present invention addresses a technical problem of introducing outside air into a body casing by rotation of a cooling fan to adequately cool a control unit provided inside the body casing, while making it less likely that wood chips, dusts or water droplets enter the body casing.

In order to solve the above technical problem, an aspect of the present invention provides a chainsaw which comprises: an electric motor provided inside a body casing; a guide bar provided in a front portion of the body casing in such a manner as to protrude forwardly; a saw chain provided around an outer periphery of the guide bar in an endlessly movable manner, and configured to be endlessly moved along the outer periphery of the guide bar under driving of the electric motor; a handle attached to the body casing, and configured to be gripped by a worker; a control unit provided inside the body casing, and configured to control driving of the electric motor; an air inlet for allowing outside air to be introduced into the body casing therethrough; and a cooling fan attached to a rotary shaft rotatable along with the driving of the electric motor, and configured to cool the control unit by outside air introduced from outside the body casing, wherein the handle comprises a base portion through which the handle is attached to the body casing, and a grip formed to extend from the base portion in such a manner as to be grippable by a worker; the air inlet is formed in a counter wall of the body casing opposed to the base portion; and the base portion is attached to the counter wall of the body casing to cover the air inlet in an air introduceable state.

In the chainsaw of the present invention having the above feature, the handle comprises a base portion through which the handle is attached to the body casing, and a grip formed to extend from the base portion in such a manner as to be grippable by a worker, and the air inlet is formed in a counter wall of the body casing opposed to the base portion, wherein the base portion is attached to the counter wall of the body casing to cover the air inlet in an air introduceable state. This makes it less likely that wood chips, dusts or water droplets enter from the air inlet into the body casing, so that the inside of the body casing of the chain saw becomes less likely to be contaminated by wood chips, dusts or the like.

Preferably, in the chainsaw of the present invention, the control unit provided inside the body casing is disposed between the air inlet and the cooling fan. According to this feature, it becomes possible to efficiently cool the control unit.

DESCRIPTION OF EXEMPLARY EMBODIMENTS

Figure 1:
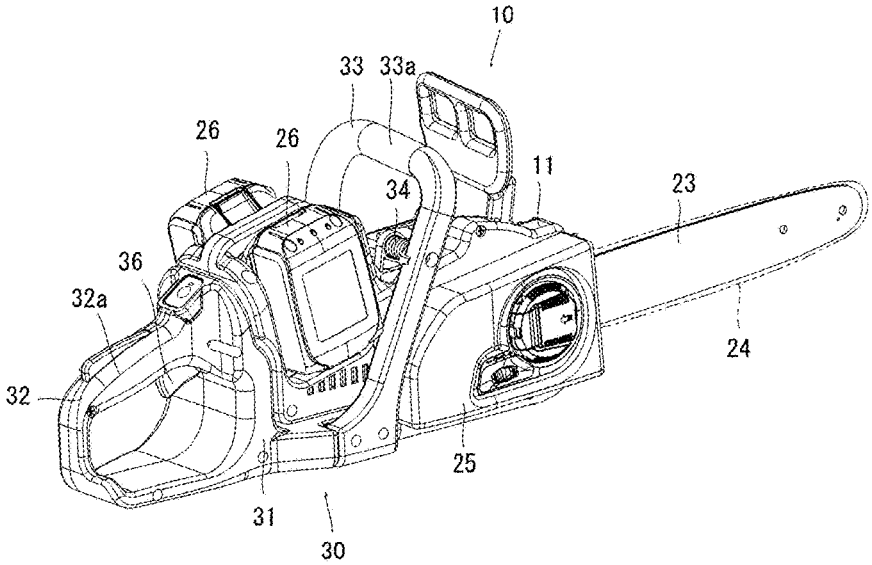
FIG. 1 is a perspective view of a chainsaw according to one embodiment of the present invention.
Figure 2:
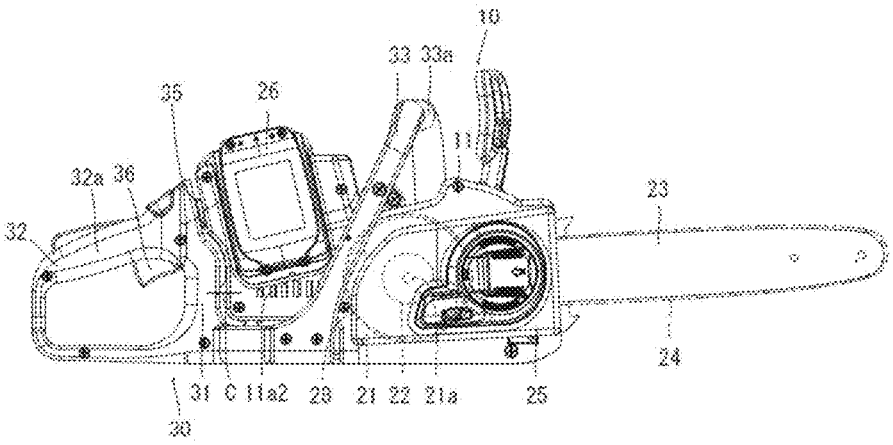
FIG. 2 is a side view of the chainsaw in FIG. 1.

With reference to the drawings, a chainsaw of the present invention will now be described based on one exemplary embodiment thereof. As depicted in FIGS. 1 and 2, a chainsaw 10 according to this embodiment comprises a body casing 11 which houses an electric motor 21 and others, and a handle 30 attached to a rear portion of the body casing 11. The electric motor 21 is provided inside the body casing 11 at a position forward of an intermediate portion of the body casing 11 in a forward/rearward direction. The electric motor 21 comprises a rotary shaft 21*a* which is rotatable along with driving of the electric motor 21 and is disposed to protrude outwardly from an intermediate region of a right lateral wall of the body casing 11. The electric motor 21 is an outer rotor-type brushless electric motor configured such that a current to be supplied to an inner stator coil is controlled by an aftermentioned control unit 27, so as to controllably rotate the rotary shaft 21*a* coupled to an outer rotor.

In the outside of the body casing 11, a sprocket 22 is fixed to the rotary shaft 21*a* of the electric motor 21. That is, the sprocket 22 is configured to be rotated under driving of the electric motor 21. A guide bar 23 is fixed to a front region of the right lateral wall of the body casing 11 at a position forward of the sprocket 22, in such a manner as to protrude forwardly, and a saw chain 24 is provided in a tensioned state between the sprocket 22 and an outer periphery of the guide bar 23 in an endlessly movable manner. A sprocket cover 25 is provided on the front region of the right lateral wall of the body casing 11, to cover the rotary shaft 21*a* of the electric motor 21, the sprocket 22, and a base end of the guide bar 23.

Figure 3:
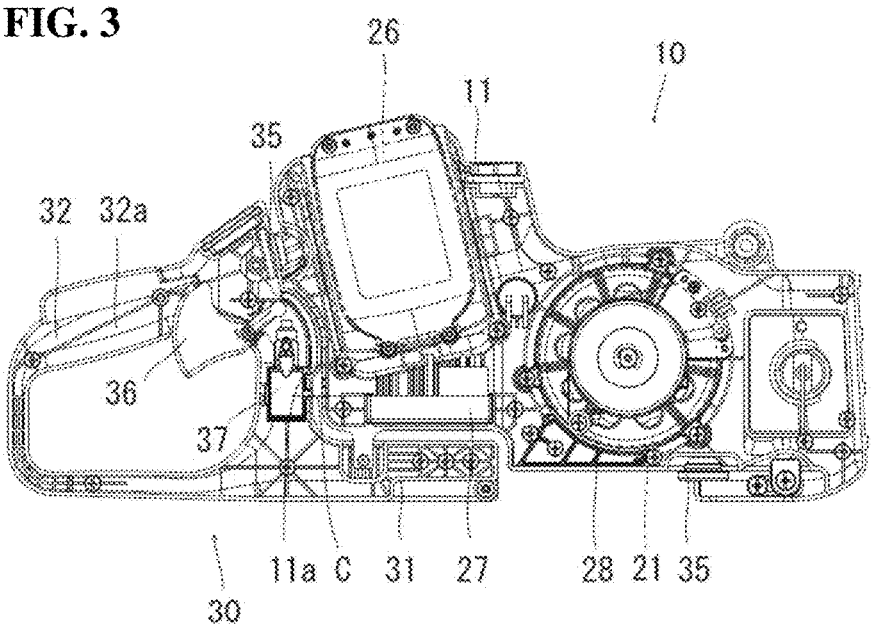
FIG. 3 is a side view of the chainsaw in FIG. 1, wherein respective right halves of a body casing and a handle are removed to bring insides thereof into view.
Figure 4:
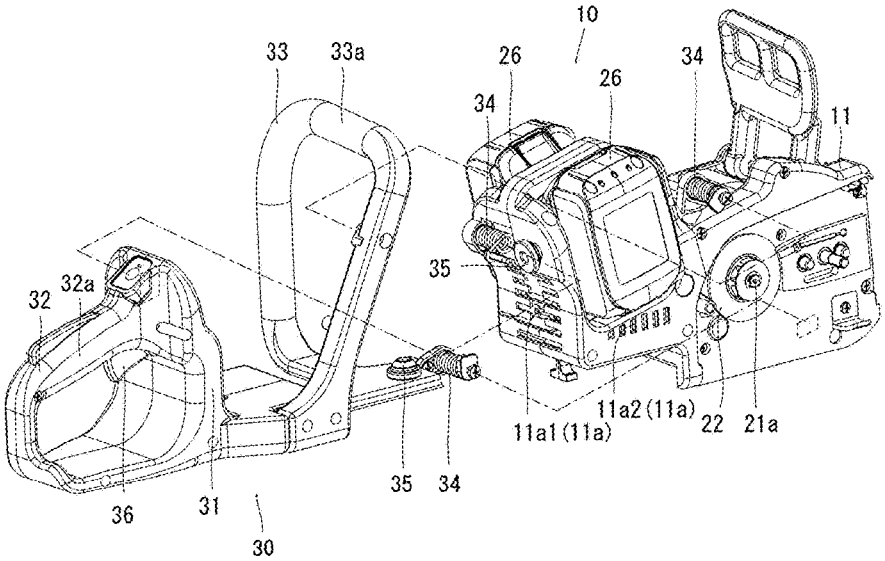
FIG. 4 is a perspective view of the chainsaw in FIG. 1, wherein the body casing and the handle are disassembled from each other.

As depicted in FIGS. 1 to 2, a battery pack 26 is detachably provided on the rear portion of the body casing 11. In this embodiment, a pair of right and left battery packs 26 are provided, respectively, on right and left opposite sides of the rear portion of the body casing 11. The battery packs 26 are operable to feed electric power to the electric motor 21 to thereby drive the electric motor 21. As depicted in FIG. 3, a control unit 27 is provided inside and on a lower rearward side of the body casing 11. The control unit 27 is operable to control driving of the electric motor 21. Specifically, the control unit 27 comprises a drive circuit (not depicted) for driving the electric motor 21 as a brushless motor. The drive circuit is operable to control a current to be supplied to the stator coil of the electric motor 21 to controllably rotate the rotor of the electric motor 21.

Within the body casing 11, a cooling fan 28 is fixed to the rotary shaft 21*a* of the electric motor 21, and an air inlet 11*a* (11*a*1, 11*a*2) is formed in each of a rear wall and rear regions of right and left lateral walls of the body casing 11 to introduce outside air therethrough by the rotation of the cooling fan 28. The cooling fan 28 is operable to suck and move air in the body casing 11 toward the rotary shaft 21*a*, and more specifically to cause outside air introduced from the air inlet 11*a* into the body casing 11 to be passed along the electric motor 21 and the control unit 27 to thereby cool the electric motor 21 and the control unit 27. The air inlet 11*a*1 in the rear wall of the body casing 11 is formed to have a total opening area greater than that of the air inlet 11*a*2 in the rear regions of the lateral walls, so that outside air is mainly introduced from the air inlet 11*a*1 of the rear wall into the body casing 11.

As depicted in FIGS. 1 and 2, the handle 30 is configured to be gripped by a worker during use of the chainsaw 10. The handle 30 is prepared separately (as a separate component) from the body casing 11, and then attached to the body casing 11 in an anti-vibration manner. The handle 30 comprises a base portion 31 through which the handle 30 is attached to the rear portion of the body casing 11, a rear grip 32*a* of a rear handle portion 32 extending from the base portion 31, and a front grip 33*a* of a front handle portion 33 extending from the base portion 31. The base portion 31 has an approximately L shape in side view, and attached to cover the rear wall and a rear region of a bottom wall of the body casing 11 serving as a mounting surface, through a gap C therebetween. The air inlet 11*a* formed in the rear wall of the body casing 11 is covered by the base portion 31 through the gap C. Thus, outside air can be introduced into the body casing 11 through the gap C between the body casing 11 and the base portion 31, and the air inlet 11*a*. An anti-vibration member comprised of a coil spring 34 or a rubber member 35 is interposed between the base portion 31 and the body casing 11, to thereby make it less likely that vibration generated in the body casing 11 is transmitted to the handle 30.

The rear handle portion 32 is formed to have a rearwardly-closed approximately-C shape, and integrated with a rear end of the base portion 31. The rear grip 32*a* is formed in an upper region of the rear handle portion 32 in such a manner as to be grippable by a worker, and provided with a trigger lever 36 configured to be swingably manipulated to trigger driving of the electric motor 21. The base portion 31 is provided with a switch unit 37 operable to output an operating signal to the control unit 27 in response to a swinging manipulation of the trigger lever 36. The switch unit 37 is electrically connected to the control unit 27. The front handle portion 33 is formed in an upwardly-closed, upside-down approximately-U shape, and fixed to the base portion 31. The front grip 33*a* is formed in an upper region of the front handle portion 33 in such a manner as to be grippable by a worker.

When the chainsaw 10 constructed as above is used in wood cutting work, a worker grips the front grip 33*a* of the front handle portion 33 and the rear grip 32*a* of the rear handle portion 32, for example, by his/her left hand and right hand, respectively, and pulls the forefinger of the right hand toward the rear grip 32*a* to swingingly move the trigger lever 36. In response to the manipulation of the trigger lever 36, the switch unit 37 outputs an operating signal to the control unit 27, and thus the electric motor 21 is driven based on control of the control unit 27. The saw chain 24 is endlessly moved along the outer periphery of the guide bar 23 by the sprocket 22 being rotated under driving of the electric motor 21. Then, the worker manipulates the handle portions 32, 33 to press, against an outer periphery of lumber such as a log, the saw chain 24 being endlessly moved along the outer periphery of the guide bar 23, to thereby cut the lumber such as a log. During this work, around the chainsaw 10, wood chips will fly apart from the lumber cut by the saw chain 24 being endlessly moved.

The chainsaw 10 according to this embodiment employs an outer rotor-type brushless electric motor 21 as a driving source to promote reductions in size and weight. As a result of employing the brushless electric motor 21, the control unit 27 for controlling driving of the electric motor 21 receives a large load and generates a large amount of heat, because it operates to control a current to be supplied to the stator coil of the electric motor 21 based on the built-in drive circuit. Therefore, in the chainsaw 10 according to this embodiment, the cooling fan 28 is provided on the rotary shaft 21*a* of the electric motor 21, to cause outside air to be sucked mainly from the air inlets 11*a*1, 11*a*2 formed in the rear wall and the rear regions of the lateral walls of the body casing 11 and then passed along the control unit 27 to thereby cool the control unit 27. In particular, the control unit 27 provided inside the body casing 11 is disposed between the air inlet 11*a* and the cooling fan 28, so that it becomes possible to effectively cool the control unit 27.

In the chainsaw 10 according to this embodiment, the handle 30 prepared separately from the body casing 11 is attached to the body casing 11. More specifically, the handle 30 comprises the base portion 31 through which the handle 30 is attached to the body casing 11, the rear grip 32*a* of the rear handle portion 32 extending from the base portion 31 in such a manner as to be grippable by a worker, and the front grip 33*a* of the front handle portion 33 extending from the base portion 31 in such a manner as to be grippable by the worker. In the chainsaw 10 according to this embodiment, the air inlet 11*a*1 is formed in the rear wall (counter wall) of the body casing 11 opposed to the base portion 31, and the base portion 31 is attached to the rear wall of the body casing 11 through the gap C to cover the air inlet 11*a*1 in an air introduceable (suctionable) state. This makes it less likely that wood chips flying apart around the chainsaw 10, dusts or water droplets enter from the air inlet 11*a*1 into the body casing 11, so that the inside of the body casing 11 of the chain saw 10 becomes less likely to be contaminated by wood chips, dusts or the like.

Although the chainsaw according to the above embodiment is a so-called "rear-handle chainsaw" comprising a rear handle and a front handle (also called "side handle"), the present invention is not limited to the rear-handle chainsaw, but may be applied to a so-called "top-handle chainsaw" comprising a top handle provided at a top of a body casing, and a front handle (also called "side handle").

What is claimed is:

1. A chainsaw comprising:

a body casing;

an electric motor provided inside the body casing;

a guide bar provided in a front portion of the body casing, the guide bar protruding forwardly from the body casing;

a saw chain provided around an outer periphery of the guide bar in an endlessly movable manner, the electric motor driving the saw chain along the outer periphery of the guide bar;

a control unit provided inside the body casing, and configured to control driving of the electric motor;

an air inlet for allowing outside air to be introduced into the body casing therethrough; and a cooling fan attached to a rotary shaft that is rotatable by the driving of the electric motor, the cooling fan being configured to cool the control unit by outside air introduced from outside the body casing, and a handle that is a separate member from the body casing, the handle being attached to the body casing with a gap therebetween, wherein the handle comprises a base portion through which the handle is attached to the body casing, and a grip formed to extend from the base portion in such a manner as to be grippable by the worker;

the body casing has a counter wall that faces the base portion of the handle;

the air inlet is formed in the counter wall; and the base portion is attached to the body casing to cover the air inlet in an air introduceable state.

2. The chainsaw as recited in claim 1, wherein the control unit provided inside the body casing is disposed between the air inlet and the cooling fan.

* * * * *